United States Patent [19]

Sekino et al.

[11] Patent Number: 5,057,868

[45] Date of Patent: Oct. 15, 1991

[54] DEVELOPING APPARATUS HAVING A SEALING CONSTRUCTION FOR PREVENTING A TONER LEAKAGE

[75] Inventors: Hitoshi Sekino; Hirofumi Hasegawa; Shuichi Nakagawa; Yuji Enoguchi, all of Osaka, Japan

[73] Assignee: Minolta Camera Kabushiki Kaisha, Osaka, Japan

[21] Appl. No.: 476,609

[22] Filed: Feb. 7, 1990

[30] Foreign Application Priority Data

Feb. 10, 1989 [JP] Japan ..... 1-31825
Feb. 10, 1989 [JP] Japan ..... 1-31830
Feb. 10, 1989 [JP] Japan ..... 1-31831

[51] Int. Cl.[5] ..... G03G 21/00

[52] U.S. Cl. ..... 355/215; 355/245; 355/251; 355/259; 118/653

[58] Field of Search ..... 355/259, 251, 253, 215, 355/245; 118/653, 661, 651

[56] References Cited

FOREIGN PATENT DOCUMENTS 0192769 8/1987 Japan ..... 355/215
0192770 8/1987 Japan ..... 355/215
0208073 9/1987 Japan ..... 355/215

OTHER PUBLICATIONS

Xerox Disclosure Journal, *End Seal For Blade Cleaner,* Lynch, Jun. 10, 1984, IP810335.

*Primary Examiner*—A. T. Grimley
*Assistant Examiner*—Thu A. Dang
*Attorney, Agent, or Firm*—Burns, Doane, Swecker & Mathis

[57] ABSTRACT

A developing apparatus having a sealing mechanism for preventing a toner leakage is disclosed. A sealing member has a recess for receiving one end of a scraper rod. In the recess, an elastic sealing plate presses the end of the scraper rod against the peripheral surface of a thin film sleeve and seals the recess. Toner transported along the inner side face of the sealing member is scraped by the end of the scraper rod. The elastic member prevents the leakage of toner which has penetrated into the contact face between the inner peripheral surface of the sealing member and the outer peripheral surface of the thin film sleeve.

14 Claims, 5 Drawing Sheets

DEVELOPING APPARATUS HAVING A SEALING CONSTRUCTION FOR PREVENTING A TONER LEAKAGE

BACKGROUND OF THE INVENTION

1. Field of the Invention

The present invention relates to a developing apparatus for use in a copying machine, a printer, a facsimile and the like. More particularly, it relates to a developing apparatus having a sealing mechanism for preventing the leakage of toners therefrom.

2. Description of the Related Art

Heretofore, a developing apparatus as shown in FIGS. 1 and 2 is proposed.

According to the developing apparatuses, a driving roller 3 is disposed in front of a developing tank 2 and a thin film sleeve 4 is mounted around the driving roller 3.

The thin film sleeve 4 is made of a resin sheet such as polyester or a thin metal film and the outer surface thereof is roughened by blast treatment. Its circumference is longer than that of the driving roller 3.

As shown in FIG. 2, a sealing member 5 disposed between the thin film sleeve 4 and a developing tank 2 is pressed against both end portions of the thin film sleeve 4 forward so that toners held by the thin film sleeve 4 on the surface thereof is prevented from dropping from both end portions thereof and the thin film sleeve 4 closely contact with the peripheral surface of the driving roller 3 so as to loosen the thin film sleeve 4 in the front thereof. As a result, a space (S) is formed between the thin film sleeve 4 and the driving roller 3 in the region in which the thin film sleeve 4 confronts an electrophotoreceptor drum 20. The space between the bottom of the thin film sleeve 4 and the developing tank 2 is also sealed. A regulating plate 8 for regulating the amount of toners to be supplied to the thin film sleeve 4 is disposed in the rear of the thin film sleeve 4. A scraper rod 9 is mounted on the regulating plate 8 in the vicinity of the bottom thereof so that the scraper rod 9 is pressed against the thin film sleeve 4.

Supposing that the friction coefficient between the thin film sleeve 4 and the driving roller 3 is $\mu_1$ and the friction coefficient between the thin film sleeve 4 and the sealing member 5 is $\mu_2$, the following relationship is established: $\mu_1 > \mu_2$.

Agitating blades 15 and 16 are disposed in a toner accommodating section 14 disposed rearward of the developing tank 2.

In the developing apparatus 1 having the above-described construction, toners accommodated in the toner accommodating section 14 are transported toward the thin film sleeve 4 due to the rotations of the agitating blades 15 and 16 in the direction shown by arrows. The driving roller 3 rotates in the direction shown by an arrow (a), which causes the thin film 4 to rotate in the direction shown by the arrow (a). In the toner accommodating section 14, part of toners held by the thin film sleeve 4 on the peripheral surface thereof are scraped by the scraper rod 9. Consequently, toners which have passed between the scraper rod 9 and the thin film sleeve 4 are electrified and form a layer of a uniform thickness.

When the electrified thin layer of toners are transported by the thin film sleeve 4 to the area in which the thin film sleeve 4 confronts the electrophotoreceptor drum 20, toners are supplied to an electrostatic latent image formed thereon.

In the developing apparatus 1 shown in FIG. 2, both end faces of the scraper rod 9 only contact with the inner peripheral surface of the sealing member 5. Thus, the sealing performance of the sealing member 5 is incomplete. Accordingly, the large amount of toner passes, in a direction indicated by an arrow (X), between the end faces of the scraper rod 9 and the inner peripheral surface of the sealing member 5 and adheres to the electrophotoreceptor drum 20 so that a fog occurs on a developed image or toners drop from the developing apparatus, thus soiling the inside of the copying apparatus.

Further, toners scraped by the scraper rod 9 drop therefrom and penetrate into the contact face between the thin film sleeve 4 and the sealing member 5, thus falling from the developing apparatus 1 or penetrating into the contact face between the driving roller 3 and the thin film sleeve 4 in the direction shown by an arrow (Y). Consequently, the driving roller 3 and the thin film sleeve 4 slip from each other and toners adhere to a bearing or a gear, which causes the unstable driving of the developing apparatus.

In order to solve the above-described problem, the sealing member 5 may be pressed against the thin film sleeve 4 in a greater force so as to prevent toners from penetrating into the contact face between the thin film sleeve 4 and the sealing member 5, but a greater torque for rotating the driving roller 3 is required. In addition, this method is incapable of completely preventing toners from penetrating therebetween.

Still further, in the above-described developing apparatus, it is necessary that the thin film sleeve 4 is pressed against the driving roller 3 in a constant force so that the thin film sleeve 4 is rotated in a constant speed by the driving roller 3.

To this end, an elastic pad made of, for example, urethane foam may be provided in the rear of the thin film sleeve 4 and the elastic pad is sandwiched between the developing tank 2 and the driving roller 3 on which the thin film sleeve is mounted. According to this construction, the thin film sleeve 4 is pressed against the driving roller 3 by the elastic rebound of the elastic pad. But the elastic rebound of the elastic pad is reduced with the elapse of time, so that toners leak through the face between the elastic pad and the thin film sleeve 4 which rotates in contact with the elastic pad and a sufficient friction force is not generated between the thin film sleeve 4 and the driving roller 3.

If the elastic pad is composed by jointing elastic pads which contact with the peripheral surfaces of both ends of the thin film sleeve 4 with an elastic pad which connect the elastic pads, toners may leak through the joints.

SUMMARY OF THE INVENTION

It is therefore an object of the present invention to provide a developing apparatus having a sealing construction to prevent the leakage of toners from the contact face between the ends of the scraper rod and the sealing member.

It is another object of the present invention to provide a developing apparatus having a sealing construction to return toners which has penetrated into the contact face between a rotating member such as a thin film sleeve and the sealing member toward the center of the rotating member.

It is still another object of the present invention to provide a developing apparatus having a sealing construction to press a sealing member against a thin film sleeve in a constant pressure for a long period of time so as to prevent the leakage of toners from the contact face between the thin film sleeve and the sealing member.

In order to accomplish the objects of the present invention, the following constructions are provided.

According to a preferred embodiment of the present invention, the following developing apparatus is provided.

The developing apparatus comprises a sealing construction for preventing a toner leakage comprises a rotating member for holding toners on peripheral surface thereof, a regulating means for adjusting amount of toners supplied to the peripheral surface thereof at a predetermined position in the outer peripheral direction of the rotating member. The regulating means has a scraper member to be pressed against the thin film sleeve along the axial direction thereof. The scraper member scrapes part of toners supplied to the peripheral surface of the rotating member so as to form a thin uniform toner layer on the peripheral surface of the rotating member. The developing apparatus further comprises a pair of sealing members disposed on both ends of the rotating member and pressed against the rotating member so that the width direction of a thin toner layer to be formed on the peripheral surface of the rotating member is regulated. Each sealing member has a recess for receiving the corresponding end of the scraper member.

The developing apparatus further comprises an elastic sealing plate, accommodated in the recess, for elastically pressing the end of the scraper member against the peripheral surface of the rotating member and sealing the recess.

According to the above-described construction, toners transported along the inner side of the sealing member are scraped by the ends of the scraper member. Toners which have penetrated into the contact face between the sealing member and the rotating member along the ends of the scraper rod is prevented by the sealing plate from moving downstream.

Accordingly, the amount of toner which may leak through the contact face between the regulating member and the sealing member in contact with both sides of the rotating member is extremely slight. As such, a developed toner image has no fog and the inside of a copying apparatus is kept to be clean.

According to another preferred embodiment of the present invention, a developing apparatus having the following construction is provided.

The developing apparatus comprises a rotating member for holding toners on a peripheral surface thereof and a regulating means for adjusting amount of toners supplied to the peripheral surface thereof at a predetermined position in the outer peripheral direction of the rotating member and having a scraper member to be pressed against the thin film sleeve along the axial direction thereof so as to scrape part of toners supplied to the peripheral surface of the rotating member so that a thin toner layer is formed on the peripheral surface of the rotating member.

The apparatus further includes a pair of sealing members disposed on both ends of the rotating member as well as both ends of the scraper member and pressed against the rotating member so that the width direction of a thin toner layer to be formed on the peripheral surface of the rotating member is regulated. Each sealing member has an inner peripheral surface which contacts with the peripheral surface of the rotating member and a step which is oblique in the direction of the rotating member and extends from the outer side of the sealing member toward the inner side thereof so that toners which have penetrated into the contact face between the peripheral surface of the rotating member and inner peripheral surface of the sealing member are pressed toward a center of the rotating member according to the rotation thereof.

According to the above-described construction, toners transported along the side of the sealing member are scraped by the scraper member so that part of toners move may penetrate between the sealing member and the rotating member. However, toners which have penetrated into the contact face between the sealing member and the thin film sleeve are transported back to the region in which the scraper member is in contact with the thin film sleeve.

Therefore, according to the developing apparatus of the present invention, the amount of toner which may leak from both outer sides of the rotating member is extremely slight.

It rarely occurs that toners drop from the sides of the driving roller after toners pass through the region in which the sealing member is in contact with the thin film sleeve. Therefore, toners do not adhere to a bearing or a gear and as such the inside of the developing apparatus can be kept to be clean and the driving system thereof is capable of smoothly working. In the developing apparatus shown in the embodiment, the thin film sleeve and the driving roller do not slip from each other because toners do not penetrate into the contact face therebetween. Accordingly, the thin film sleeve can be stably driven.

According to still another preferred embodiment of the present invention, a developing apparatus having the following construction is provided.

The developing apparatus has a sealing construction for preventing a toner leakage comprises a driving roller, and a thin film sleeve having a circumference longer than that of the driving roller and a peripheral surface for holding toners. The thin film sleeve is mounted around the peripheral surface of the driving roller. Therefore, the developing apparatus further comprises regulating means for adjusting the amount of toners supplied to the peripheral surface thereof at a predetermined position in the outer peripheral direction of the thin film sleeve. The regulating means has a scraper member to be pressed against the thin film sleeve along the axial direction thereof. The scraper member scrapes part of toners supplied to the peripheral surface of the thin film sleeve so as to form a thin uniform toner layer on the peripheral surface of the thin film sleeve.

The developing apparatus further comprises sealing means pressed against the thin film sleeve so that the width direction of a thin toner layer to be formed on the peripheral surface of the thin film sleeve is regulated, and a developing tank accommodating the driving roller, the thin film sleeve, the regulating means, and the sealing means.

The sealing means comprises a sealing member including a pair of side sealing sections to be pressed against both sides of the peripheral surface of the thin film sleeve and a bottom sealing section integrated with one end of the side sealing section in a seamless condition and pressing the peripheral surface of the thin film sleeve along the axial direction thereof, and the bottom sealing section of the sealing member is fixed to a bottom frame of the developing tank. Each of the pair of side sealing sections is held by pressing means mounted on the upper frame of a developing tank, and the pressing means presses the side sealing section against the peripheral surface of the thin film sleeve by applying tensile force to the side sealing section.

According to the above-described construction, since tensile force is applied to the side sealing section of the thin film sleeve, the thin film sleeve closely contacts with the driving roller.

Tensile force is stably applied to the side sealing section by the pressing member. Accordingly, the thin film sleeve can be stably pressed against the driving roller and toners can be prevented from leaking through the contact face between the thin film sleeve and the side sealing section.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
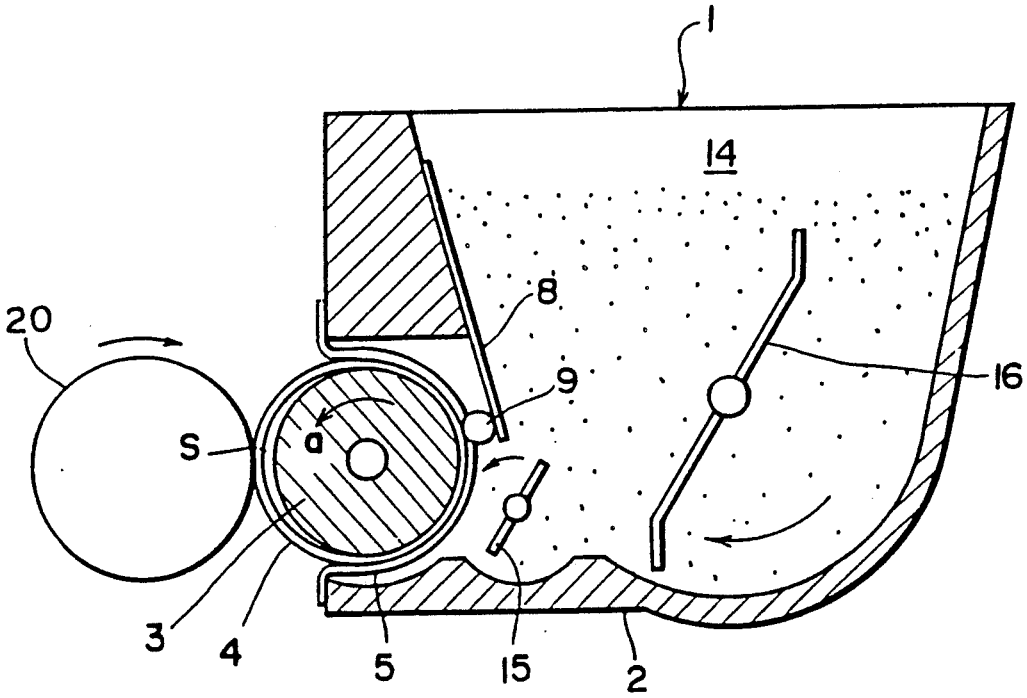
Fig. 1 PRIOR ART
FIG. 1 is a sectional view showing a known developing apparatus, as previously described.
Figure 2:
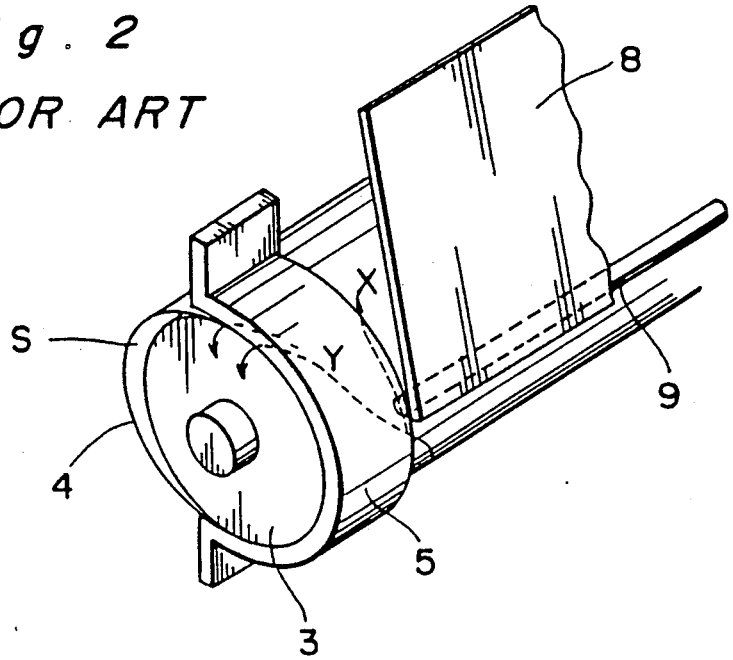
Fig. 2 PRIOR ART
FIG. 2 is a perspective view showing an essential section of the developing apparatus shown in FIG. 1, as previously described.

Referring now to the drawings, the embodiments of the present invention are described below.

First embodiment

Figure 3:
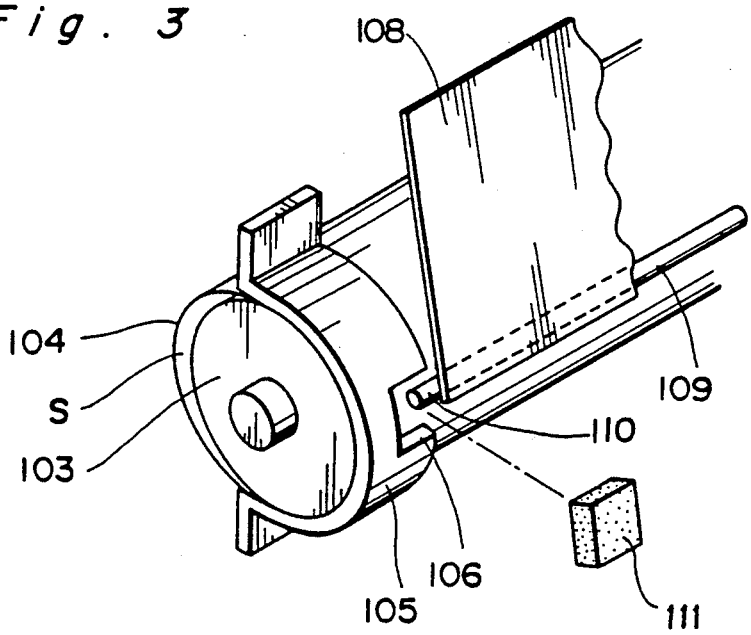
FIGS. 3, 4, and 5 are perspective views showing a developing apparatus according to a first embodiment of the present invention.
Figure 4:
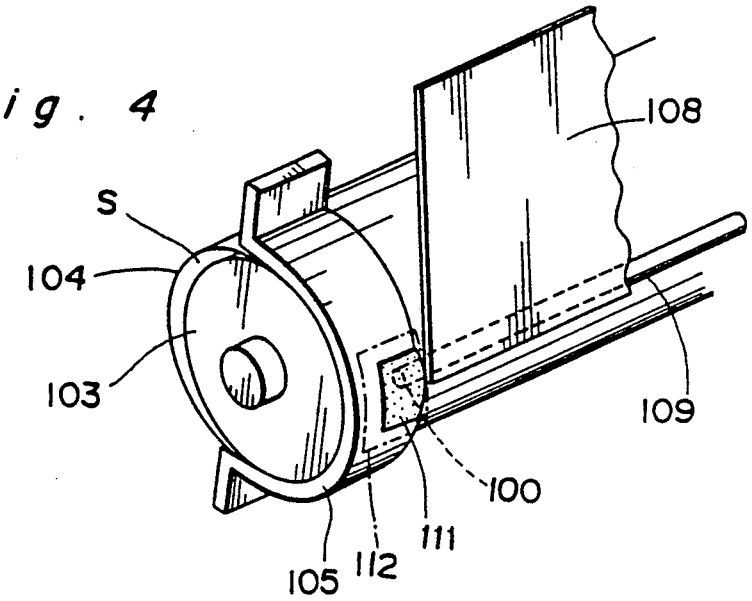
Figure 5:
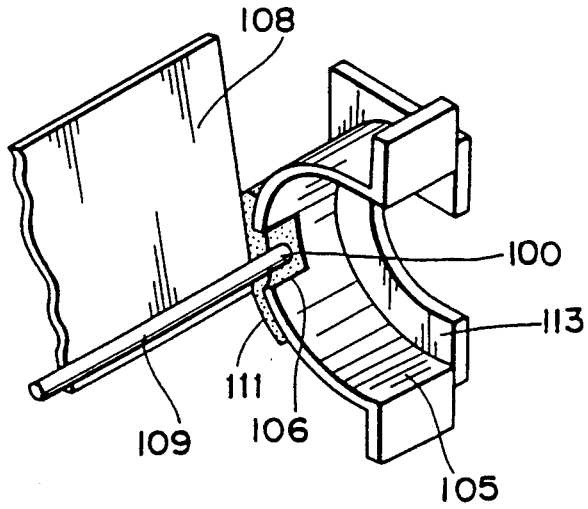

FIGS. 3 through 5 show an essential section of a developing apparatus according to a first embodiment of the present invention and constructions not shown are similar to those shown in FIG. 1.

Both ends 100 of a scraper rod 109 mounted on a regulating plate 108 in the bottom thereof extend into the region in which a thin film seat 104 contacts with an approximately semispherical sealing member 105.

A concave cutout 106 through which the end 100 of the scraper rod 109 penetrates is formed on the sealing member 105 at a predetermined position thereof. An elastic sealing plate 111 is mounted in the cutout 106 so as to press the end 100 of the scraper rod 109. A region 112 shown by a dashed line in FIG. 4 is pressed by a pressing member (not shown). The cutout 106 into which the end 100 penetrates is sealed by the elastic sealing plate 111.

A stopper plate 113 for preventing the thin film sleeve 104 from moving axially is mounted on the sealing member 105.

It is preferable that the sealing member 105 is made of a resin sheet selected from polyethylene, nylon, polyacetal, polypropylene, and the like or a sheet composed of an elastic material such as polyurethane and the resin sheet fixed to the elastic material. The sealing member 105 is pressed against the thin film sleeve 104 by applying tensile force thereto through an elastic means (not shown) disposed between the sealing member 105 and a developing tank disposed in the rear thereof. It is preferable to use polyurethane foam or the like as the elastic sealing plate 111.

Part of toners transferred from a toner accommodating section 114 and held by the surface of the thin film sleeve 104 driven by the driving roller 103 is scraped by the scraper rod 109 of the toner scraping plate 108. Consequently, a thin toner layer is formed. In both ends of the scraper rod 109, part of toners do not penetrate into the contact face between the sealing member 105 and the thin film sleeve 104 for the reason described below. Most of toners which have moved toward the sealing member 105 are prevented by the elastic plate 111 from penetrating into the cutout 116, thus dropping to the toner accommodating section 114. But part of toners penetrates into the region of the cutout 106 and is likely to move in the downstream side of the scraper rod 109 after passing around the end 100 of the scraper rod 109. However, the elastic plate 111 disposed in the periphery of the end 100 applies a great amount of resistance to toners. As a result, toners is incapable of moving in the upstream side of the end 100 and such toners stay in the periphery of the end 100. Thus, the amount of toner which moves in the downstream side of the scraper rod 109 is extremely slight.

In the above-described embodiment, the present invention is applied to the developing apparatus in which the thin film sleeve 104 mounted around the driving roller 103 holds toners, but the present invention can be applied to a developing apparatus in which the driving roller 103 holds toners.

Second embodiment

Figure 6:
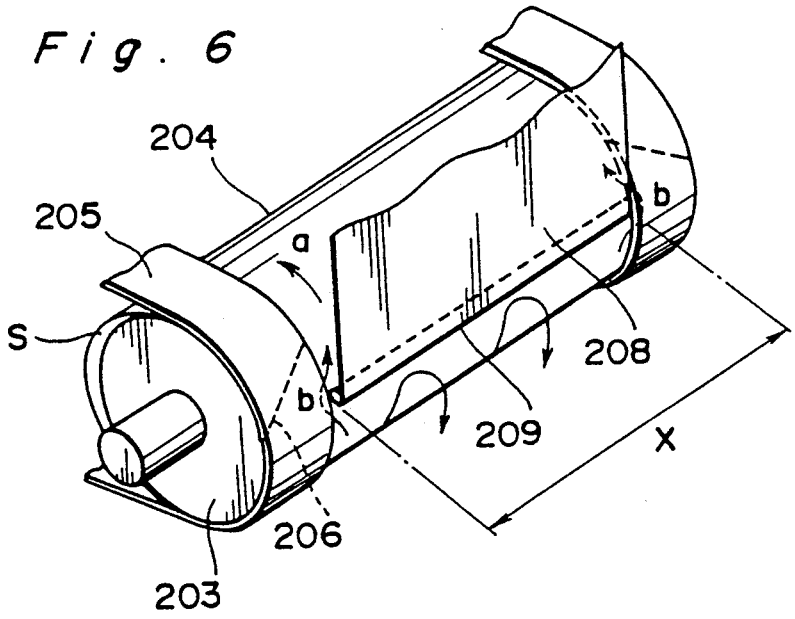
FIGS. 6 and 7 are perspective views showing a developing apparatus according to a second embodiment of the present invention.
Figure 7:
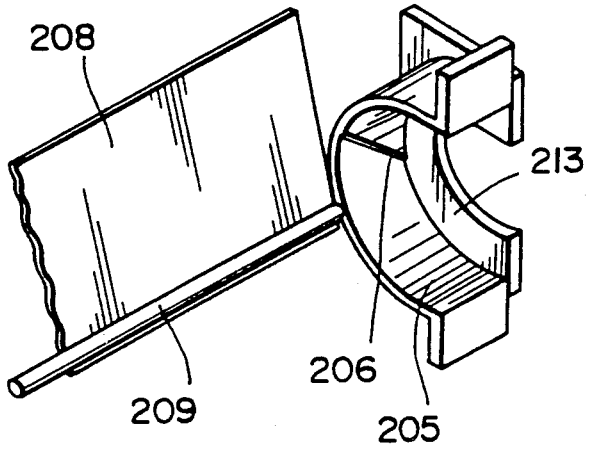
Figure 8:
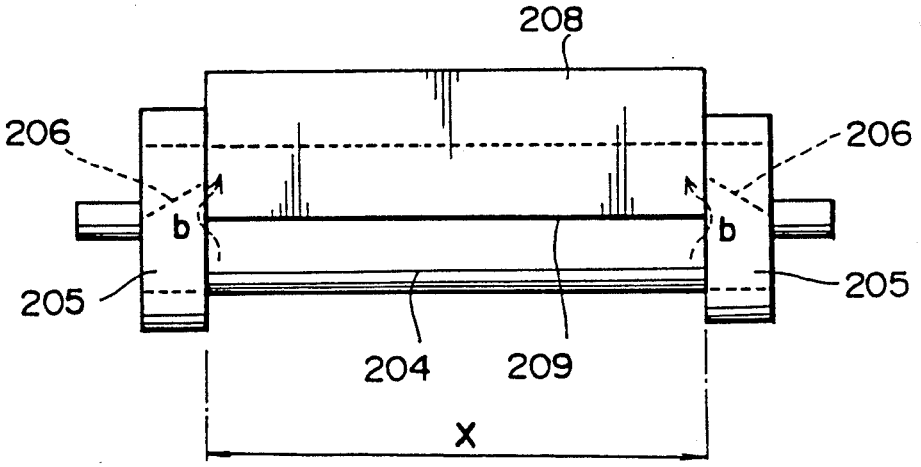
FIG. 8 is a rear elevation of the developing apparatus shown in FIGS. 6 and 7.

FIGS. 6 through 8 show an essential section of a developing apparatus according to a second embodiment of the present invention and constructions not shown are similar to those shown in FIG. 1.

A sealing member 205 is made of a resin sheet such as polyethylene, nylon, polyacetal, polypropylene or the like. Referring to FIG. 6, in the direction (a) in which a thin film sleeve 204 rotates, an oblique step 206 is formed upwards on the inner peripheral surface of the sealing member 205 a certain distance apart from a line formed by straightly extending the line of the scraper rod 209 of a toner scraping member 208. The thickness of the oblique step is greater in the downstream side (the direction (a)) than in the upstream side. The oblique step 206 is formed by adhering a resin sheet to the inner surface of the sealing member 205. The oblique step 206 may be formed when the sealing member 205 is molded.

In this developing apparatus, toners held by the thin film sleeve 204 driven by the driving roller 203 is scraped by the scraper rod 209 of the toner scraping member 208 and part of toners moves toward both sides of the thin film sleeve 204 along the scraper rod 209.

Toners which have penetrated into the contact face between the sealing member 205 and the thin film sleeve 204 move in the direction shown by an arrow (b). That is, first, toners are transported in the direction as shown by the arrow (a) according to the rotation of the thin film sleeve 204, then moved toward the center of the thin film sleeve 104 by the oblique step 206 in the upstream side thereof, thus returning to a region (X) in which the toner amount scraping member 208 contacts with thin film sleeve 204.

Therefore, it seldom occurs that toners which have penetrated into the contact face between the sealing member 205 and the thin film sleeve 204 drop from both ends of the driving roller 203.

In the above-described embodiment, the present invention is applied to the developing apparatus in which the thin film sleeve 204 mounted around the driving roller 103 holds toners, but the present invention can be applied to a developing apparatus in which the driving roller 203 holds toners.

Third embodiment

Figure 9:
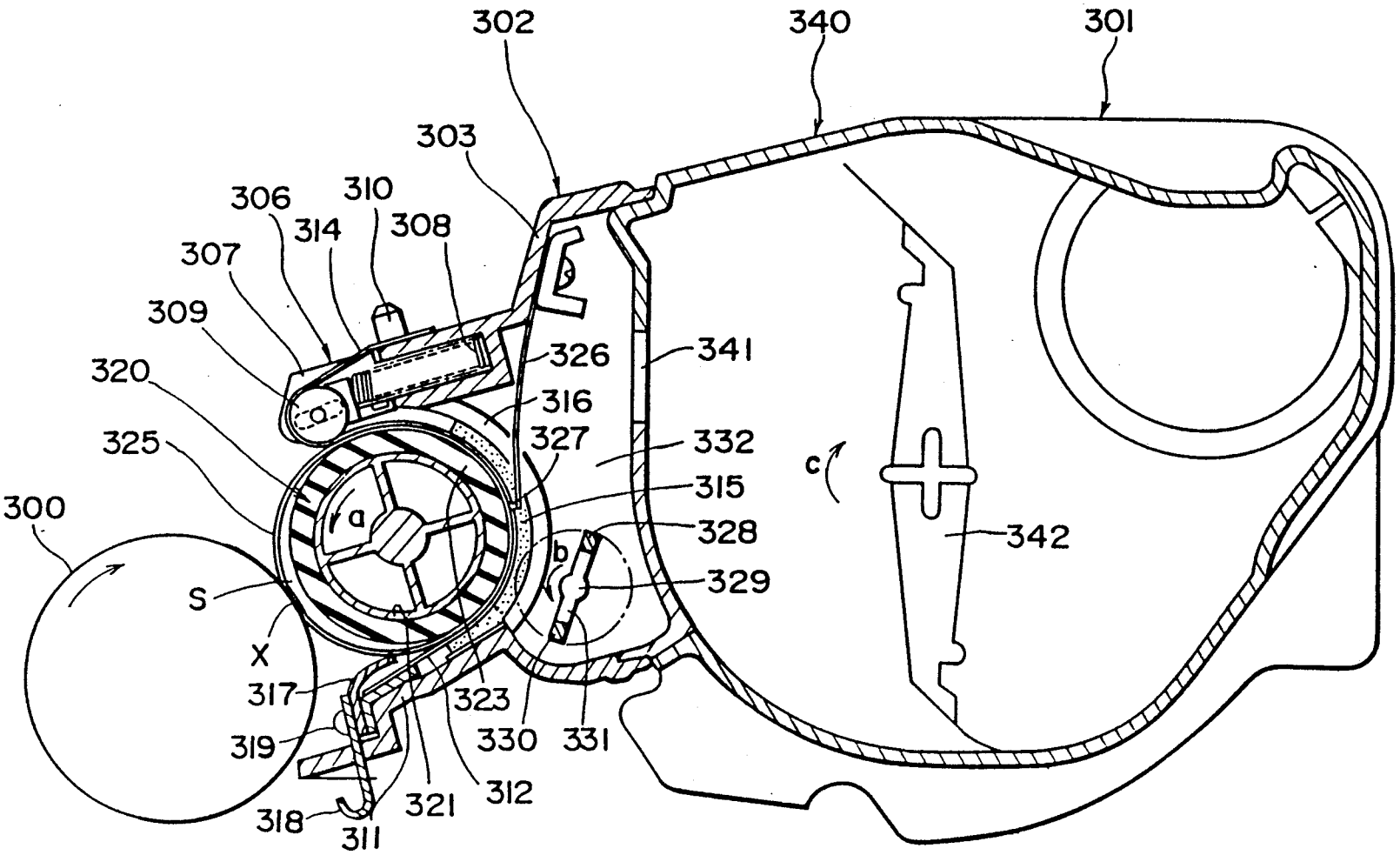
FIG. 9 is a sectional view showing a developing apparatus according to a third embodiment of the present invention.
Figure 10:
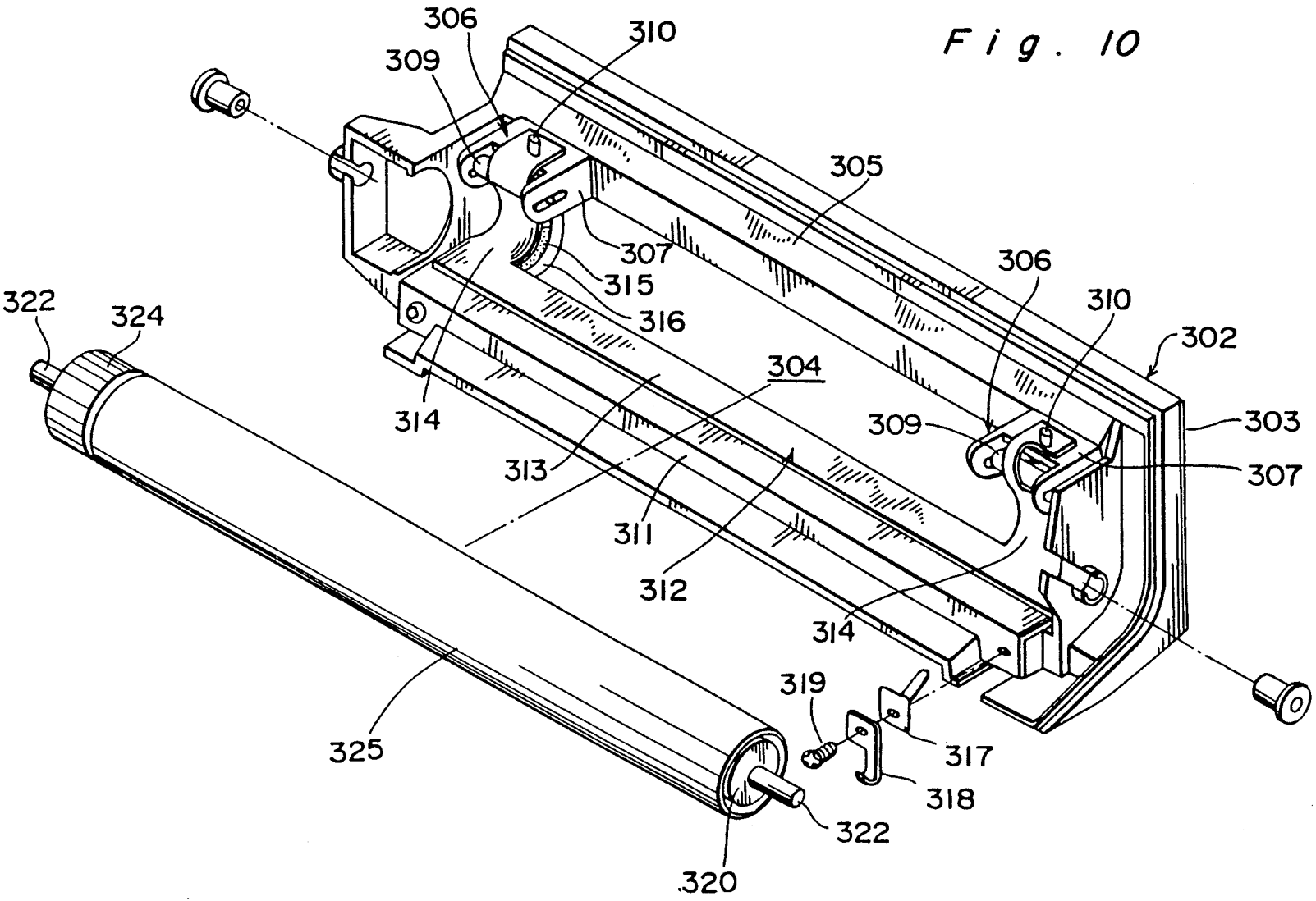
FIG. 10 is an exploded perspective view showing the developing apparatus shown in FIG. 9.

A developing apparatus in accordance with a third embodiment is shown in FIGS. 9 and 10.

Referring to FIGS. 9 and 10, a developing apparatus 301 comprises a developing section 302 and a toner hopper 340.

In the developing tank 303 of the developing section 302, pressing mechanisms 306 and 306 are mounted on both sides of an upper frame 305. The pressing mechanism 306 comprises a housing 307, a roller 309 disposed in the housing 307 and movable forward and backward in the housing 307, and a spring 308 which urges the roller 309 forward therein. A sealing member 312 made of polyester film mounted in the developing tank 303 comprises a bottom sealing section 313 fixed to the bottom frame 311 of the developing tank 303 and a pair of side sealing sections 314 and 314 extending upward from the bottom sealing section 313. An elastic sealing member 315 made of urethane foam or the like is adhered to the back face of the bottom sealing section 313 and the side sealing section 314. Each of the side sealing sections 314 and 314 of the sealing member 312 extends upward on the housing 307 along the peripheral surface of the roller 309 and fixed to the housing 307 by a projection 310. The sealing member 312 and the elastic sealing member 315 are both solid or seamless.

A contact 317 and a power terminal 318 connected to a power line of the main body of the developing apparatus are fixed to the bottom frame 311 at one side thereof.

A driving roller 320 comprises a metal core 321 and a cylindrical member 323 such as rubber which closely contacts with the metal core 321 and has a gear 324 formed thereon at one side thereof. A thin film sleeve 325 is mounted around the cylindrical member 323. The thin film sleeve 325 is made of an electroformed nickel thin film mounted around the driving roller 320, so that the circumference of the thin film sleeve 325 is a little longer than that of the driving roller 320 and the peripheral surface of the thin film sleeve 325 is roughened by blast treatment. The thin film sleeve 325 is loosened in a small extent when it is mounted around the driving roller 320.

When the thin film sleeve 325 is mounted around the driving roller 320, the driving roller 320 presses the side sealing sections 314 and 314 at both ends of the thin film sleeve 325 and is accommodated in a region 304 of the developing tank 303 in opposition to the pressure of the rollers 309 and 309 urged to move forward by the springs 308 and 308. The shafts 322 and 322 projecting from both ends of the core metal 321 are rotatably supported by the developing tank 303 through a bearing mounted on the side wall thereof. A contact 317 is pressed against the peripheral surface of the thin film sleeve 325.

Supposing that the friction coefficient between the peripheral surface of the cylindrical member 323 of the driving roller 320 and the inner peripheral surface of the thin film sleeve 325 is $\mu_1$ and the friction coefficient between the peripheral surface of the thin film sleeve 325 and the side sealing section 314 is $\mu_2$, the following relationship is established: $\mu_1 >> \mu_2$, so that with the rotation of the driving roller 320 in the direction shown by an arrow (a), the thin film sleeve 325 rotates in the same direction.

As a result of the mounting of the driving roller 320 in the region 304 of the developing tank 303, tensile force is applied to the side sealing sections 314 and 314 by the springs 308 and 308. Consequently, the side sealing members 314 and 314 closely contact with the thin film sleeve 325. Further, the elastic sealing member 315 fixed to the back face of the sealing member 312 is pressed against a wall 316 formed on the inner side wall of the developing tank 303 spaced a predetermined interval from the peripheral surface of the driving roller 320. The elastic sealing member 315 fixed to the back face of the bottom sealing section 313 is pressed against the bottom frame 311.

Since the inner surface of the thin film sleeve 325 is pressed against the driving roller 320 by the pressing mechanism 306, the side walls 314 and 314, and the elastic sealing member 315, the front of the thin film sleeve 325 is loosened. Thus, a space (S) is formed between the driving roller 320 and the thin film sleeve 325.

Thus, in the region between the side sealing sections 314 and 314, the scraper rod 327 provided to a toner scraping plate 326 mounted on the upper frame 305 is pressed against the thin film sleeve 325 of the driving roller 320 mounted on the developing tank 308. In this embodiment, the scraper rod 327 is round, but may be U-shaped or V-shaped.

An agitating blade 328 composed by mounting shafts 329 and 329 on both ends of a blade 330 having an opening 331 is rotatably mounted in the toner accommodating section 332 disposed in the rear of the driving roller 320.

A toner hopper 340 mounted on the rear of the developing tank 302 forms the rear partition of the toner accommodating section 332.

The toner hopper 340 has in its front an opening 341 which communicates with the toner accommodating section 332 and accommodates an agitating blade 342 in approximately the center thereof.

Toners are accommodated both in the toner accommodating section 332 and the toner hopper 342. Nonmagnetic toners are preferably used, but magnetic toners may also be used.

The developing apparatus having the construction described above is accommodated in the main body of such as a copying machine. As described previously, the space (S) is formed between the thin film sleeve 325 and the driving roller 320. The thin film sleeve 325 contacts a electrophotoreceptor drum 300. The terminal 318 for connecting the main body of the developing apparatus to the power source is connected with the power source. The driving roller 320 and the agitating blades 328 and 342 are connected to the driving system of the main body through the gear 324 and a gear mechanism (not shown), respectively.

The developing apparatus 301 carries out a development as follows:

When the driving roller 320, the agitating blades 328 and 342 start rotating by the driving source (not shown) in the directions shown by the arrows (a), (b), and (c), respectively, the thin film sleeve 325 rotates in the direction shown by the arrow (a) and toners accommodated in the toner accommodating section 332 and the toner hopper 340 move in the directions (b) and (c), respectively.

Toners accommodated in the toner accommodating section 332 adhere to the surface of the thin film sleeve 325 and transported in the direction of (a) and fed to a wedge-shaped space formed between the thin film sleeve 325 and the scraper rod 327 of the toner scraping plate 326. Part of toners is scraped by the scraper rod 327. Consequently, toners which have not scraped forms a uniform thin layer and are frictionally positively or negatively charged.

Toners held by the thin film sleeve 325 are transported to a developing region (developing region) (X) in which the electrophotoreceptor drum 300 and the thin film sleeve 325 confront, and then transferred to an electrostatic latent image formed on the surface of the electrophotoreceptor drum 300 by a voltage between the surface potential of the electrophotoreceptor drum 300 and a bias voltage applied to the thin film sleeve 325 through the contact 317. As a result, a toner image is formed.

As described previously, the space (S) is formed between the thin film sleeve 325 and the driving roller 325. The thin film sleeve 325 which is brought in contact with electrophotoreceptor drum 300 is not in contact with the driving roller 320, the thin film sleeve 325 softly and uniformly contacts with the electrophotoreceptor drum 300 only through the rigidity thereof and the contact area therebetween is appropriate. Thus, a uniform toner image corresponding to the electrostatic latent image is formed on the electrophotoreceptor drum 300.

Toners which have remained on the thin film sleeve 325, namely, toners which have not been supplied to the electrostatic latent image in the developing region (X) are transported in the direction shown by the arrow (a), then, transported to the toner accommodating section 332 after passing through the bottom sealing section 313 of the sealing member 312. Thereafter, toners corresponding to the amount of toners which have been consumed in this developing operation are supplied. Thus, the above-described operation is repeated.

Each time toners accommodated in the toner accommodating section 332 are consumed, toners which move according to the rotation of the agitating blade 342 in the toner hopper 340 pass through the opening 341. Thus, toners are supplied to the toner accommodating section 332.

In the developing section 302 of the developing apparatus 301, since the gap between the thin film sleeve 325 and the developing tank 303 is sealed by the elastic sealing member 315 and the sealing member 312, toners do not leak through the contact face therebetween. Tensile force is stably applied to the side sealing sections 314 and 314 by the springs 308 and 308 of the pressing mechanism 306 and 306. Therefore, toners do not leak through the face in which the sealing member 312 and the thin film sleeve 325 contact with each other. Further, since the sealing member 312 and the elastic sealing member 315 are solid, the sealing performances of these two members are preferable.

A conductive metal thin film consisting of nickel is used as the thin film sleeve 325 in the third embodiment, however, the thin film sleeve 325 may be made of chrome, a resin sheet consisting of such as polyamide, polyester or a material formed by laminating a metal thin film and a resin sheet with each other.

The bias voltage is applied to the thin film sleeve 325 through the contact 317 in the third embodiment, but the bias voltage may be applied to a conductive member formed by evaporating a thin metal film over a resin film may be used as the sealing member 312. Thus, the number of parts to construct the developing apparatus can be reduced. Further, the thin film sleeve 325 can be favorably electrified by the use of such a conductive member because the contact area between the thin film sleeve 325 and the sealing member 312 is great.

Although the present invention has been fully described in connection with the preferred embodiments thereof with reference to the accompanying drawings, it is to be noted that various changes and modification are apparent to those skilled in the art. Such changes and modification are to be understood as included within the scope of the present invention as defined by the appended claims unless they depart therefrom.

What is claimed is:

1. A developing apparatus having a sealing construction for preventing a toner leakage, comprising:

a rotating member for holding toner on a peripheral surface thereof;

a regulating means for adjusting an amount of toner supplied to said peripheral surface at a predetermined position in an outer peripheral direction of said rotating member, said regulating means including a scraper member to be pressed against said rotating member along an axial direction thereof so as to scrape part of a toner supplied to said peripheral surface of said rotating member so that a thin uniform toner layer is formed on said peripheral surface of said rotating member;

a pair of sealing members disposed on both ends of said rotating member and pressed against said rotating member so that a width of said thin toner layer to be formed on said peripheral surface of said rotating member is regulated, said sealing members each having a recess for receiving an end of said scraper member, respectively; and a pair of elastic sealing plates mounted in said recesses in said sealing members, said elastic sealing plates elastically pressing said ends of said scraper member against said peripheral surface of said rotating member and sealing said recess.

2. A developing apparatus as claimed in claim 1, wherein said rotating member includes a driving roller and a thin film sleeve having a larger circumference than a circumference of said driving roller and a peripheral surface for holding toner, said thin film sleeve being mounted around a peripheral surface of said driving roller so as to be sandwiched between said sealing members and said driving roller, whereby said thin film sleeve slips from said sealing member when said thin film sleeve rotates due to a rotation of said driving roller.

3. A developing apparatus as claimed in claim 1, wherein said scraper member comprises a rod extending in an axial direction of said rotating member.

4. A developing apparatus as claimed in claim 1, wherein said sealing member is formed of polyethylene.

5. A developing apparatus as claimed in claim 1, wherein said elastic sealing plate is formed of polyurethane.

6. A developing apparatus having a sealing construction for preventing a toner leakage, comprising:

a rotating member for holding toner on a peripheral surface thereof;

a regulating means for adjusting an amount of toner supplied to said peripheral surface at a predetermined position in an outer peripheral direction of said rotating member and including a scraper member to be pressed against said rotating member along an axial direction thereof so as to scrape part of a toner supplied to said peripheral surface of said rotating member so that a thin toner layer is formed on said peripheral surface of said rotating member;

a pair of sealing members disposed on both ends of said rotating member as well as both ends of said scraper member and pressed against said rotating member so that a width of said thin toner layer to be formed on said peripheral surface of said rotating member is regulated, each of said sealing members having an inner peripheral surface which contacts with said peripheral surface of said rotating member and a step which is oblique in a rotational direction of said rotating member and which extends from an outer side of said sealing member toward an inner side thereof so that toner which has penetrated into a contact face between said peripheral surface of said rotating member and said inner peripheral surface of said sealing member is pressed toward a center of said rotating member.

7. A developing apparatus as claimed in claim 6, wherein said rotating member includes a driving roller and a thin film sleeve having a larger circumference than a circumference of said driving roller and a peripheral surface for holding toner, said thin film sleeve being mounted around a peripheral surface of said driving roller so as to be sandwiched between said sealing member and said driving roller, whereby said thin film sleeve slips from said sealing member when said thin film sleeve rotates due to a rotation of said driving roller.

8. A developing apparatus as claimed in claim 7, wherein said sealing member is formed of polyethylene.

9. A developing apparatus as claimed in claim 7, further including stopper means mounted on said outer side of each of said sealing members to prevent said thin film sleeve from moving axially.

10. A developing apparatus having a sealing construction for preventing a toner leakage, comprising:

a driving roller;

a thin film sleeve having a larger circumference than a circumference of said driving roller and a peripheral surface for holding toner, said thin film sleeve being mounted around a peripheral surface of said driving roller;

regulating means for adjusting an amount of toner supplied to said peripheral surface of said thin film sleeve at a predetermined position in an outer peripheral direction of said thin film sleeve, said regulating means including a scraper member which is pressed against said thin film sleeve along an axial direction thereof so as to scrape part of a toner supplied to said peripheral surface of said thin film sleeve so that a thin uniform toner layer is formed on said peripheral surface of said thin film sleeve;

sealing means to be pressed against said thin film sleeve so that a width of a thin toner layer to be formed on said peripheral surface of said thin film sleeve is regulated; and a developing tank accommodating said driving roller, said thin film sleeve, said regulating means, and said sealing means, said sealing means including a sealing member having a pair of side sealing sections which press against both sides of said peripheral surface of said thin film sleeve, and a bottom sealing section which is seamlessly integrated with ends of said side sealing sections and which presses said peripheral surface of said thin film sleeve along said axial direction thereof, and said bottom sealing section of said sealing member being fixed to a bottom frame of said developing tank, each of said pair of side sealing sections being held by pressing means mounted on an upper frame of said developing tank, said pressing means for pressing said side sealing sections against said peripheral surface of said thin film sleeve by applying tensile force to said side sealing sections.

11. A developing apparatus as claimed in claim 10, further comprising:

an elastic sealing member disposed between a back surface of said sealing member and a pressing face of said developing tank so as to elastically press said sealing member against said thin film sleeve.

12. A developing apparatus as claimed in claim 10, wherein said sealing member is formed of polyester.

13. A developing apparatus as claimed in claim 10, wherein said pressing means includes a pair of rollers each contacting with one of said side sealing sections, and springs for urging said rollers so that tensile force is applied to said side sealing sections.

14. A developing apparatus having a sealing construction for preventing a toner leakage, comprising:

a rotating member for holding toner on a peripheral surface thereof; and a sealing member having a pair of side sealing sections which press against both sides of a peripheral surface of said rotating member, and a bottom sealing section which is seamlessly integrated with said side sealing sections and which presses said peripheral surface of said rotating member.

* * * * *